US005350463A

United States Patent [19]

Tsukamoto et al.

[11] Patent Number: 5,350,463

[45] Date of Patent: Sep. 27, 1994

[54] MAGNETICALLY GRADUATED STEEL BAR

[75] Inventors: Takashi Tsukamoto, Kitakyushu; Masakazu Nakazato, Sagamihara, both of Japan

[73] Assignees: Sumitomo Metal Industries, Ltd., Osaka; Kayaba Industry Co., Ltd., Tokyo, both of Japan

[21] Appl. No.: 926,643

[22] Filed: Aug. 10, 1992

[30] Foreign Application Priority Data

Aug. 13, 1991 [JP] Japan ..... 3-203007

[51] Int. Cl.[5] ..... C22C 38/40

[52] U.S. Cl. ..... 148/307; 148/310; 148/325; 148/902; 148/903

[58] Field of Search ..... 148/307, 310, 325, 327, 148/902, 903, 904; 420/43, 56

[56] References Cited

U.S. PATENT DOCUMENTS 2,506,558 5/1950 Goller ..... 148/307

3,282,686 11/1966 Allen ..... 148/325

3,971,676 7/1976 Detert et al. ..... 148/310

FOREIGN PATENT DOCUMENTS 57-16309 1/1982 Japan .

62-83620 4/1987 Japan .

*Primary Examiner*—George Wyszomierski

*Attorney, Agent, or Firm*—Burns, Doane, Swecker & Mathis

[57] ABSTRACT

A magnetically graduated steel bar is provided with a magnetic scale that has a steel composition consisting, on a weight basis, of 0.02–0.10% C, 0.50–1.0% Mn, 0.50–1.0% Si, 17–20% Cr, 5–8% Ni, 0.05–0.20% C plus N, and a balance of Fe and incidental impurities. The steel contains 30–60 vol % of a cold working induced martensite and is given a nonmagnetic austenitic structure by local melting. The steel bar has a tensile strength of at least 130 kgf/mm$^2$ and a fatigue strength of at least 60 kgf/mm$^2$.

17 Claims, 3 Drawing Sheets

MAGNETICALLY GRADUATED STEEL BAR

BACKGROUND OF THE INVENTION

The present invention relates to a magnetically graduated steel bar, and more particularly a magnetically graduated steel rod to be used with a positioning cylinder in the mechanical and electronic industry.

The position of positioning cylinders has conventionally been detected with sensors attached to the cylinders, such as rotary encoders.

FIG. 1 is a schematic diagram showing a layout for controlling the position of a piston rod by means of a conventional rotary encoder. A cylinder 10 is equipped with a piston rod 12, which is fitted with a position measuring roller 14. The rotational number of the roller 14 and other positioning data are sent to a position measuring unit 16 and the position of the rod 12 is determined by sensing the deviation of the rotational angle from a reference value. The unit 16 sends a control signal to a hydraulic drive circuit for the rod 12, and its position is corrected by opening either valve 20 or 22.

However, this method has various disadvantages including insufficient precision and lack of ruggedness. To solve these problems, Unexamined Published Japanese Patent Application Nos. 16309/1982, 83620/1987, etc. have proposed magnetic scales in the form of a piston rod on a cylinder that is graduated with respect to magnetism and combined with a magnetic sensor to detect the position of the rod itself. In fact, however, the magnetic scale disclosed in Unexamined Published Japanese Patent Application No. 16309/1982 has such small differences in magnetism in the graduated portion that a special design feature is necessary for the detecting unit; and, the precision of detection has not been very high. The magnetic scale described in Unexamined Published Japanese Patent Application No. 83620/1987 is characterized in that it should contain at least 10 vol % of martensite in order to insure its performance as a scale (the steel composition is not limited in any particular way). For practical applications, the martensite content is limited to 40% or less (11–26% in the examples) in order to prevent cracking. The highest tensile strength that can be attained in the examples is about 120 kgf/mm$^2$. The patent makes no mention of fatigue characteristics which are important properties of steel bars.

Piston rods for use with cylinders are conventionally made of steel bars that are prepared by quenching and tempering "structural steels" which are typified by S45C. Magnetic scales in which a ferromagnetic martensite is combined with a nonmagnetic austenite have heretofore been proposed as magnetically graduated rods for use with positioning cylinders in the mechanical and electronic industry. However, those magnetic scales have had problems with respect to mechanical properties and the precision of the scale.

More specifically, steel bars that are to be used as piston rods on cylinders and which are graduated magnetically have been proposed as an alternative to the conventional sensors, but they have had the following disadvantages:

(1) Emphasis has been placed solely on improving scale characteristics, and the mechanical properties of the scales are by no means better than those of conventional scales;

(2) The scales have unsatisfactory fatigue characteristics, which are extremely important mechanical properties; and (3) The scale characteristics are by no means satisfactory.

Furthermore, the use of such steel bars in heavy and varying load applications has increased, so their operating environments have become more severe. Specific applications include actuators for construction machines and large industrial machines used in high,load environments, as well as hydraulic units for vehicle suspensions subjected to high-repetition, varying loads.

SUMMARY OF THE INVENTION

Thus, there has arisen a strong need to improve the mechanical characteristics, and particularly the fatigue strength, of magnetically graduated steel bars. The measures that have been conventionally taken to improve these properties are mostly based on treatments for surface modification such as carburizing and nitriding; however, none of those methods has proved to be satisfactory in terms of the strength and corrosion resistance of the resulting bars.

The general object of the present invention is to provide a magnetically graduated steel rod for use with positioning cylinders that can solve all of the aforementioned problems of the prior art.

A specific object of the present invention is to provide a magnetically graduated steel bar that has a sufficiently high tensile strength (>130 kgf/mm$^2$) and fatigue strength (>60 kgf/mm$^2$) to be useful as a magnetically graduated rod on positioning cylinders.

The present inventors made the following discoveries.

(1) A magnetic scale produced by a process comprising cold drawing an instable austenite to form martensite and then performing local melting of the martensite so that it reverts to austenite will achieve the highest tensile strength and fatigue strength when the martensite content is 30–60 vol % and if the scale is made of a steel having the composition set forth hereinafter.

(2) It is generally difficult to produce 30–60 vol % martensite by cold drawing but this can be accomplished by a steel composition containing 0.02–0.10% C, 0.50–1.0% Mn, 0.5–1.0% Si, 17–20% Cr, 5–8% Ni and 0.05–0.20% (C+N), and the content of cold working induced martensite can be increased to 30–60 vol % without causing any deterioration in the magnetic characteristics of the product steel.

Based on these findings, the present inventors accomplished the present invention, which provides a magnetically graduated steel bar that has a steel composition consisting, on a weight basis, essentially of 0.02–0.10% C, 0.50–1.0% Mn, 0.50–1.0% Si, 17–20% Cr, 5–8% Ni, 0.05–0.20% (C plus N), and a balance of Fe and incidental impurities, and that contains 30–60 vol % of a cold working induced martensite and that is made to have a nonmagnetic austenitic structure so as to provide a magnetic scale by local melting, the steel bar having a tensile strength of at least 130 kgf/mm$^2$ and a fatigue strength of at least 60 kgf/mm$^2$.

DESCRIPTION OF THE PREFERRED EMBODIMENTS

Figure 1:
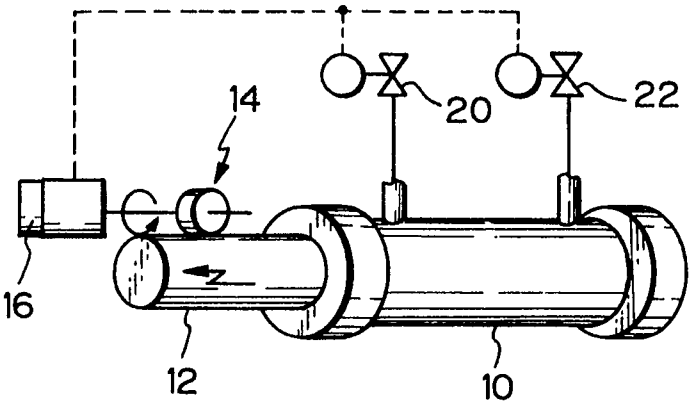
Fig. 1 PRIOR ART
FIG. 1 is a schematic view of a conventional rotary encoder being used to control the position of an actuator.

The reasons for the above-described steel composition of the present invention will now be described.

C:

Carbon not only has a hardening effect but also influences the stability of austenite. When the carbon content is less than 0.02%, austenite becomes so instable that ferrite will form in the steel and reduce its performance as a scale. In addition, the strength of the steel will not improve. When the carbon content exceeds 0.10%, the ductility of the cold working-induced martensite will decrease and the martensite cannot be produced in the necessary amount. So, the carbon content is limited to the range of 0.02–0.10%.

Si:

Silicon is a ferrite-forming element but it has little effect on austenite stability. Instead, it affects and reduces the ductility of the strain-induced martensite, i.e. cold working induced martensite. In order to enable martensite to be produced in the necessary amount, it is desirable that the silicon content is limited to 1.0% or below. However, the desired steel strength cannot be assured if the silicon content is less than 0.5%. So, the silicon content is limited to the range of 0.5–1.0%.

Mn:

Manganese is an austenite-forming element, but it has little effect on austenite stability. Like silicon, manganese affects and reduces the ductility of strain-induced martensite. In order to enable martensite to be produced in the necessary amount, it is desirable that the manganese content is limited to 1.0% and below. However, when the manganese content is less than 0.50%, the desired strength cannot be assured. So, the manganese content is limited to the range of 0.50–1.0%.

Cr:

When the chromium content is less than 17%, the level of chromium in the strain-induced martensite will decrease and the strength of the final product will be unable to exceed the target 130 kgf/mm$^2$. Therefore, it is desirable that chromium is contained in an amount of at least 17%. On the other hand, when the chromium content exceeds 20%, the chance of forming ferrite increases, and ferrite will form even in the austenite to decrease the performance of the steel as a scale (i.e., sensor output and detection error). Hence, the upper limit of the chromium content is 20%. In the present invention, the chromium content is limited to the range of 17–20%, and preferably 17–18%.

Ni:

When the nickel content is less than 5%, ferrite will form in the austenite and degrade the performance of the product steel as a scale. In addition, subsequent cold working will yield a three-phase mixed structure consisting of ferrite, martensite and austenite and the target value of fatigue strength cannot be attained. Hence, it is desirable that nickel is present in an amount of 5% or more. On the other hand, when the nickel content exceeds 8%, the austenite is stabilized and the amount of martensite is insufficient to attain the target values for scale performance and strength. Hence, the upper limit of the nickel content is 8%. In the present invention, the nickel content is limited to the range of 5–8%, and preferably 5–7%.

C+N:

The combined contents of carbon and nitrogen are limited to the range of 0.05–0.20%, and preferably 0.05–0.15%. If the total content of C+N is less than 0.05%, ferrite will form in the austenite and degrade the performance of the product steel as a scale. In addition, subsequent cold working will yield a three-phase mixed structure consisting of ferrite, martensite and austenite and the target value for fatigue strength cannot be attained. Hence, it is desirable that the level of C+N is at least 0.05%. When the sum of C+N exceeds 0.20%, the austenite is stabilized and the amount of martensite is insufficient to attain the target values for scale performance and strength. In addition, the ductility (drawing property) of the steel will decrease. Hence, the upper limit for the (C+N) level is defined as 0.20% and the preferred range is 0.05–0.15%.

Other impurities that may be present in the steel of the present invention are P and S. Generally speaking, each of these may be present in an amount of up to 0.010% without causing any adverse effects on the tensile strength and fatigue strength of the product steel.

Figure 2:
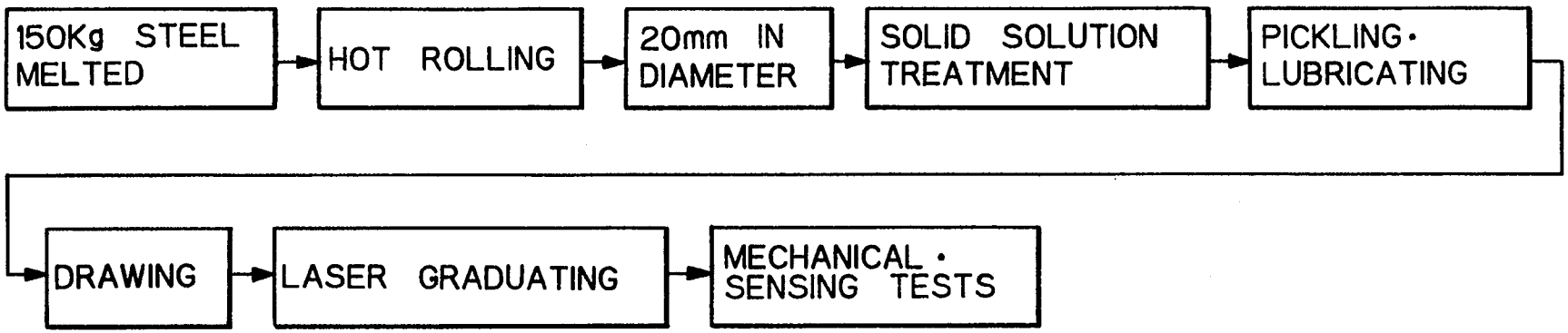
FIG. 2 is a flow chart of the production of the magnetically graduated steel bar of the present invention.

FIG. 2 is a flow chart of a process for producing the magnetically graduated steel bar of the present invention. The process starts with melting a steel weighing 150 kg, for example, and hot rolling the melt to form a bar having a diameter of 20 mm. Prior to cold working, the bar is subjected to a solution heat treatment at 1000°–1100° C., and then to pickling and lubricating treatment. Thereafter, the bar is cold drawn to a smaller diameter of 16.5 mm. In order to insure that martensite will form in an amount of 30–60 vol % as a result of cold working, i.e. strain induction, the percentage of cold working, or the reduction of area, is preferably in the range of 25–45%.

To provide the steel with a magnetic scale, laser light is applied to melt the steel in selected areas, which will turn into a non-magnetic austenitic structure. After laser graduation, the steel bar is subjected to a mechanical test and a sensing test to check if it has predetermined mechanical and magnetic characteristics.

In the present invention, the amount of cold working induced martensite is limited the range of 30–60 vol % for the following reasons.

When the amount of the cold working induced martensite is less than 30 vol %, the target values for tensile strength and fatigue strength, which are 130 kgf/mm$^2$ and 60 kgf/mm$^2$, respectively, cannot be attained. Hence, the amount of the cold working induced martensite is restricted to at least 30 vol %. On the other hand, when the amount of the cold working induced martensite exceeds 60 vol %, the fatigue strength of the steel will decrease and the target fatigue strength cannot be attained. Hence, the upper limit of the amount of the cold working induced martensite is defined as 60 vol %. In short, when the percentage of drawing is made excessively high in order to form an increased amount of martensite, the negative effect of residual stress can no longer be neglected.

Preferably, the amount of the martensite is 40–55 vol %.

The cold working induced martensite is usually produced by cold drawing, and the amount produced is proportional to the percentage of cold working. If it is desired to produce martensite in an amount of 60 vol %, it is necessary to perform about 40–45% working.

Other cold working treatments that may be adopted to produce strain-induced martensite include cold rolling between roll passes.

As already mentioned in connection with the description of the prior art, specific examples of applications that require high tensile strength and fatigue strength include actuators which are to be used under high loads (such as in construction equipment and large industrial machines) and hydraulic units which are subjected to high-repetition, varying loads (such as in vehicle active suspensions). In the past, these requirements have been partly met by heat treatments (e.g. quenching, tempering, carburizing and nitriding) or alloying processes. Compared to these conventional techniques, the present invention offers particularly great merits, since it is only necessary to subject a steel of a predetermined composition to cold working, which also serves as a shaping step.

EXAMPLES

Steel materials having the compositions shown in Table 1 were hot rolled, cold rolled and laser graduated in accordance with the flow chart shown in FIG. 2. In each run, 150 kg of steel was melted, hot rolled to a bar having a diameter of 20 mm, and subjected to a solution heat treatment at 1050° C.

In the graduation step, a $CO_2$ laser beam producing a spot diameter of 1 mm at a power of 0.5 kW was used to melt the drawn bar in selected areas to a depth of 0.4 mm at a speed of 1 m/min, thereby forming a scale consisting of molten marks 1.0 mm wide that were spaced with a pitch of 2.0 mm. The bars were visually checked for melting. Upon being left to stand, the molten areas of each bar rapidly solidified.

After the graduation step, the bars were wet polished on their surfaces by a thickness of 0.05 mm so that each marking had a width of 0.9 mm.

Figure 3:
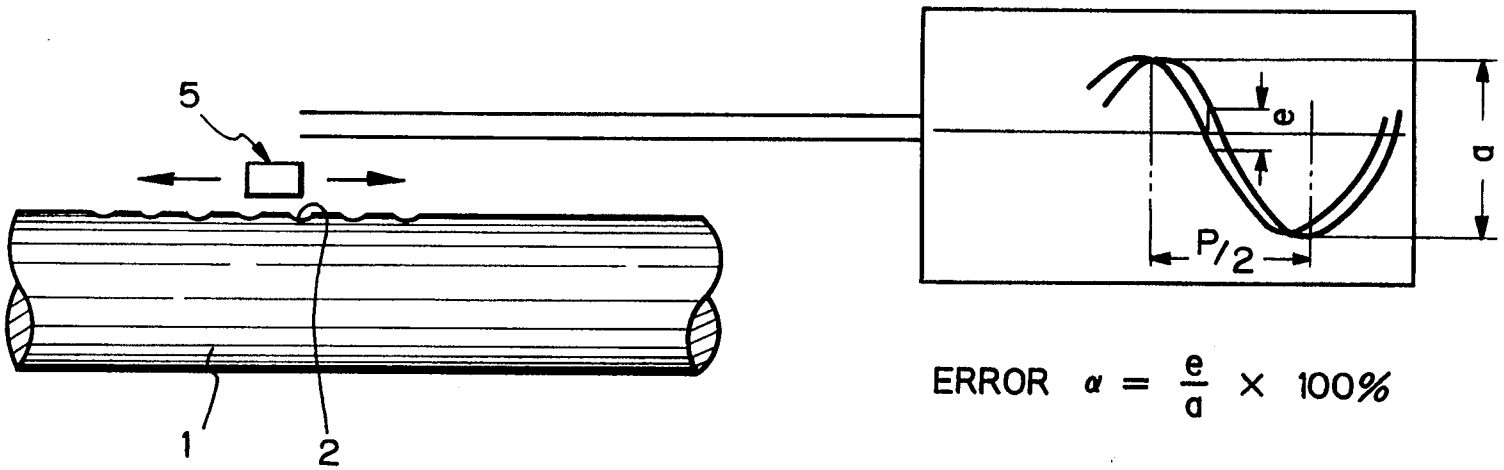
FIG. 3 schematically illustrates a procedure for measuring errors in a sensing test.

The thus prepared samples of magnetically graduated steel bars were subjected to a sensing test by the following procedure in the manner shown in FIG. 3. A magnetic sensor 5 was brought into proximity with the surface of magnetically graduated steel bar 1 and moved back and forth over the marks 2 in the direction of the arrows. The waveforms of the resulting output signals were recorded as shown on the right side of FIG. 3 and the error $\alpha$ was determined from the difference between the waveform of the output signal produced upon the movement of the sensor in one direction and the waveform of the output signal produced upon movement in the opposite direction. A sample passed the test if $\alpha$ was equal to or less than 4%. The error $\alpha$ is defined as stated in FIG. 3, where a denotes the full amplitude of output, e denotes the difference between two outputs, one being produced upon sensor movement in one direction and the other being produced upon sensor movement in the opposite direction, and P denotes the pitch of two markings.

After recording the waveforms of the output signals, the samples were subjected to a mechanical test and the fatigue strength of each sample of the magnetically graduated steel bars was verified by a rotary bending test.

Table 1 shows the results of measurement of the error $\alpha$ and fatigue strength.

Figure 4:
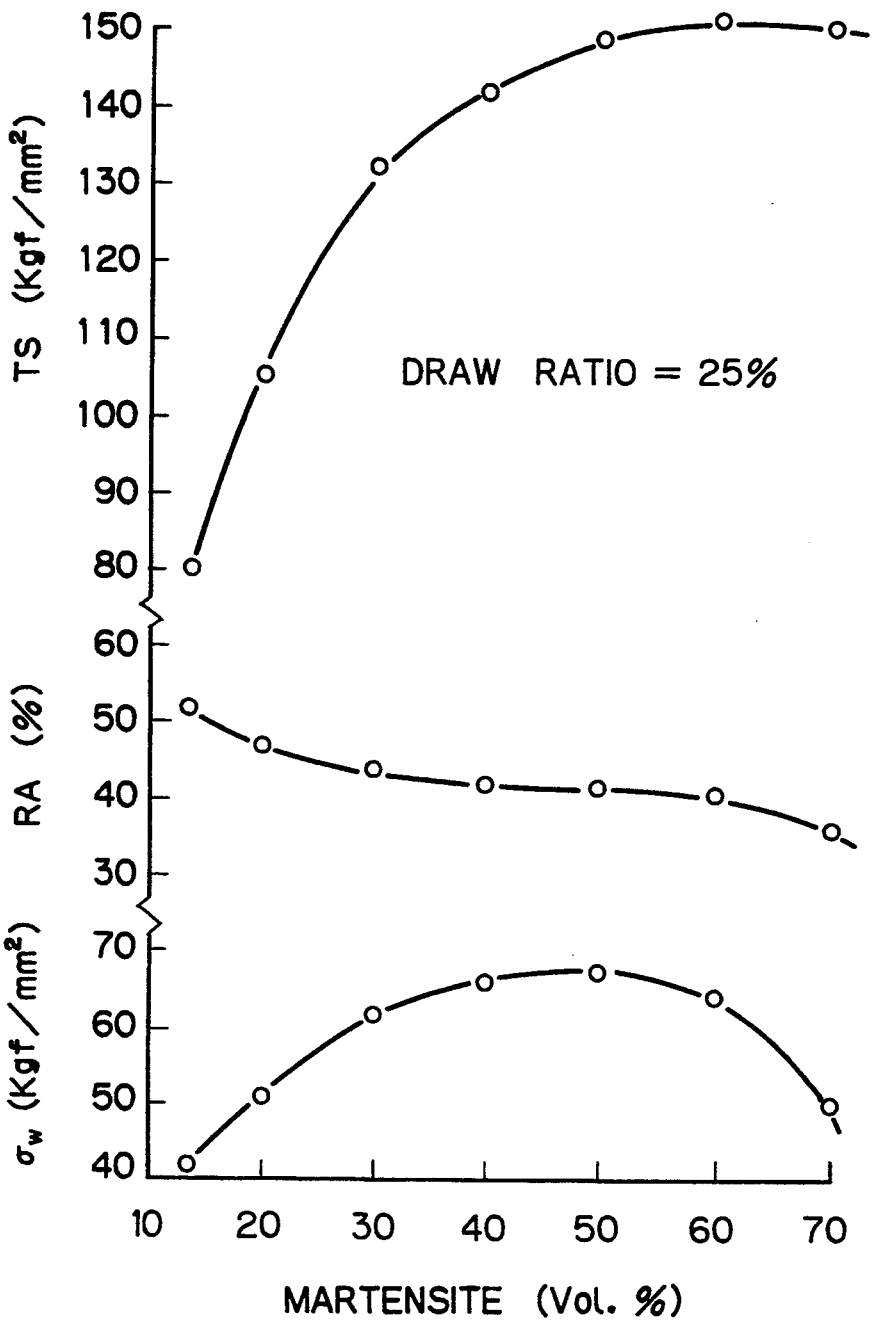
FIG. 4 is a graph showing various properties of examples of the present invention as a function of martensite content.

FIG. 4 is a graph showing the correlation between the amount of cold working induced martensite in a steel and its mechanical characteristics ($\sigma_w$-fatigue strength, RA-reduction of area, and TS-tensile strength).

TABLE 1

| Run No. | C | Mn | Si | P | S | Cr | Ni | N | C + N | Rd (%) | Martensite (vol %) | TS (kgf/mm²) | RA (%) | $\sigma_w$ (kgf/mm²) | Error (%) | Remarks |
|---|---|---|---|---|---|---|---|---|---|---|---|---|---|---|---|---|
| 1 | 0.05 | 0.80 | 0.80 | 0.010 | 0.010 | 16.0* | 6.0 | 0.05 | 0.10 | 35 | 45 | 115* | 45 | 55* | 5 | Comparison |
| 2 | 0.05 | 0.80 | 0.80 | 0.010 | 0.010 | 17.0 | 6.0 | 0.05 | 0.10 | 35 | 46 | 137 | 45 | 63 | 3 | Invention |
| 3 | 0.05 | 0.80 | 0.80 | 0.010 | 0.010 | 20.0 | 6.0 | 0.05 | 0.10 | 35 | 46 | 142 | 42 | 65 | 3 | Invention |
| 4 | 0.05 | 0.80 | 0.80 | 0.010 | 0.010 | 21.0* | 6.0 | 0.05 | 0.10 | 35 | 46 | 146 | 42 | 67 | 12 | Comparison |
| 5 | 0.05 | 0.80 | 0.80 | 0.010 | 0.010 | 17.5 | 4.0* | 0.05 | 0.10 | 35 | 47 | 138 | 44 | 55* | 9 | Comparison |
| 6 | 0.05 | 0.80 | 0.80 | 0.010 | 0.010 | 17.5 | 5.0 | 0.05 | 0.10 | 35 | 53 | 152 | 41 | 69 | 2 | Invention |
| 7 | 0.05 | 0.80 | 0.80 | 0.010 | 0.010 | 17.5 | 8.0 | 0.05 | 0.10 | 35 | 45 | 145 | 42 | 65 | 3 | Invention |
| 8 | 0.05 | 0.80 | 0.80 | 0.010 | 0.010 | 17.5 | 9.0* | 0.05 | 0.10 | 35 | 20* | 120* | 46 | 50* | 10 | Comparison |
| 9 | 0.05 | 0.80 | 0.80 | 0.010 | 0.010 | 17.5 | 6.0 | 0.02 | 0.03* | 35 | 35 | 132 | 44 | 50* | 9 | Comparison |
| 10 | 0.05 | 0.80 | 0.80 | 0.010 | 0.010 | 17.5 | 6.0 | — | 0.05 | 35 | 45 | 141 | 42 | 62 | 3 | Invention |
| 11 | 0.05 | 0.80 | 0.80 | 0.010 | 0.010 | 17.5 | 6.0 | 0.15 | 0.20 | 35 | 35 | 137 | 44 | 63 | 3 | Invention |
| 12 | 0.05 | 0.80 | 0.80 | 0.010 | 0.010 | 17.5 | 6.0 | 0.17 | 0.22* | 35 | 25* | 117* | 35 | 56* | 8 | Comparison |
| 13 | 0.05 | 0.80 | 0.80 | 0.010 | 0.010 | 17.5 | 6.0 | 0.05 | 0.10 | 20 | 20* | 115* | 47 | 49* | 8 | Comparison |
| 14 | 0.05 | 0.80 | 0.80 | 0.010 | 0.010 | 17.5 | 6.0 | 0.05 | 0.10 | 38 | 50 | 147 | 42 | 69 | 2 | Invention |
| 15 | 0.05 | 0.80 | 0.80 | 0.010 | 0.010 | 17.5 | 6.0 | 0.05 | 0.10 | 49 | 67* | 154 | 32 | 50* | 3 | Comparison |
| 16 | 0.05 | 1.4* | 0.80 | 0.010 | 0.010 | 17.5 | 6.0 | 0.05 | 0.10 | 35 | 27* | 137 | 43 | 61 | 8 | Comparison |

Note 1: An asterisk indicates a value outside the scope of the present invention.
Note 2: Run No. 16 is equivalent to the composition described in Unexamined Publishied Japanese Patent Application No. 83620/1987.

As described in the foregoing pages, the present invention provides a magnetically graduated steel bar having sufficiently high precision, tensile strength and fatigue strength to be useful for positioning cylinders which are employed in the mechanical and electronic and other industries. The steel bar is particularly useful in industrial machines carrying heavy and varying loads for which there is a strong need today for improved positioning cylinders.

What is claimed:

1. A magnetically graduated steel bar provided with a magnetic scale that has a steel composition consisting, on a weight basis, essentially of 0.02–0.10% C, 0.50–1.0% Mn, 0.50–1.0% Si, 17–20% Cr, 5–8% Ni, 0.05–0.20% C plus N, and the balance of Fe and incidental impurities, that contains 30–60 vol % of a cold working induced martensite and that has been given a nonmagnetic austenitic structure by local melting, the steel bar having a tensile strength of at least 130 kgf/mm² and a fatigue strength of at least 60 kgf/mm², the magnetic scale comprising spaced-apart areas of the nonmagnetic austenitic structure separated by areas of ferromagnetic martensite.

2. A magnetically graduated steel bar provided with a magnetic scale as set forth in claim 1 wherein the amount of Cr is 17–18%.

3. A magnetically graduated steel bar provided with a magnetic scale as set forth in claim 1 wherein the amount of Ni is 5–7%.

4. A magnetically graduated steel bar provided with a magnetic scale as set forth in claim 1 wherein wherein the amount of C+N is 0.05–0.15%.

5. A magnetically graduated steel bar provided with a magnetic scale as set forth in claim 1 wherein the amount of the martensite is 40–55 vol %.

6. A magnetically graduated steel bar provided with a magnetic scale as set forth in claim 1 wherein the cold working has been carried out with a reduction of area in the range of 25–45%.

7. A magnetically graduated steel bar provided with a magnetic scale as set forth in claim 1, wherein the nonmagnetic austenitic structure has been formed by melting localized areas of a surface of the bar to a depth of up to 0.4 mm.

8. A magnetically graduated steel bar provided with a magnetic scale as set forth in claim 1, wherein the cold working induced martensite has been produced by cold drawing the bar by at least a 25% reduction in area.

9. A magnetically graduated steel bar provided with a magnetic scale as set forth in claim 1, wherein the local melting has been performed by a laser beam having a spot diameter of about 1 min.

10. A magnetically graduated steel bar provided with a magnetic scale that has a steel composition consisting, on a weight basis, essentially of 0.05% C, 0.80% Mn, 0.80% Si, 17–20% Cr, 5–8% Ni, 0.05–0.20% C plus N, and the balance of Fe and incidental impurities, that contains 30–60 vol % of a cold working induced martensite and that has been given a nonmagnetic austenitic structure by local melting, the steel bar having a tensile strength of at least 130 kgf/mm$^2$ and a fatigue strength of at least 60 kgf/mm$^2$, the magnetic scale comprising spaced-apart areas of the nonmagnetic austenitic structure separated by areas of ferromagnetic martensite.

11. A magnetically graduated steel bar provided with a magnetic scale as set forth in claim 10, wherein the magnetic scale comprises spaced-apart areas of the nonmagnetic austenite structure located on an outer periphery of the bar.

12. A magnetically graduated steel bar provided with a magnetic scale as set forth in claim 10, wherein the nonmagnetic austenitic structure has been formed by melting localized areas of a surface of the bar to a depth of up to 0.4 mm.

13. A magnetically graduated steel bar provided with a magnetic scale as set forth in claim 10, wherein the cold working induced martensite has been produced by cold drawing the bar by at least a 25% reduction in area.

14. A magnetically graduated steel bar provided with a magnetic scale as set forth in claim 10, wherein the local melting has been performed by a laser beam having a spot diameter of about 1 mm.

15. A magnetically graduated steel bar provided with a magnetic scale as set forth in claim 10, wherein the bar includes a plurality of evenly spaced-apart areas of the nonmagnetic austenitic structure separated by areas of ferromagnetic martensite.

16. A magnetically graduated steel bar provided with a magnetic scale that has a steel composition consisting, on a weight basis, essentially of 0.02–0.10% C, 0.50–1.0% Mn, 0.50–1.0% Si, 17–20% Cr, 5–8% Ni, 0.05–0.20% C plus N, and the balance of Fe and incidental impurities, that contains 30–60 vol % of a cold working induced martensite and that has been given a nonmagnetic austenitic structure by local melting, the steel bar having a tensile strength of at least 130 kgf/mm$^2$ and a fatigue strength of at least 60 kgf/mm$^2$, the magnetic scale comprising spaced-apart areas of the non magnetic austenitic structure separated by areas of ferromagnetic martensite located on an outer periphery of the bar.

17. A magnetically graduated steel bar provided with a magnetic scale that has a steel composition consisting, on a weight basis, essentially of 0.02–0.10% C, 0.50–1.0% Mn, 0.50–1.0% Si, 17–20% Cr, 5–8% Ni, 0.05–0.20% C plus N, and the balance of Fe and incidental impurities, that contains 30–60 vol % of a cold working induced martensite and that has been given a nonmagnetic austenitic structure by local melting, the steel bar having a tensile strength of at least 130 kgf/mm$^2$ and a fatigue strength of at least 60 kgf/mm$^2$, the bar including a plurality of evenly spaced-apart areas of the nonmagnetic austenitic structure separated by areas of ferromagnetic martensite.

* * * * *